US006012984A

United States Patent [19]

Roseman

[11] Patent Number: 6,012,984

[45] Date of Patent: Jan. 11, 2000

[54] SYSTEMS FOR PROVIDING LARGE ARENA GAMES OVER COMPUTER NETWORKS

[75] Inventor: Stuart Roseman, Boston, Mass.

[73] Assignee: Gamesville.Com,Inc., Boston, Mass.

[21] Appl. No.: 08/827,853

[22] Filed: Apr. 11, 1997

[51] Int. Cl.[7] ..... A63F 9/22

[52] U.S. Cl. ..... 463/42; 463/1; 463/42

[58] Field of Search ..... 463/41, 42, 1, 463/16, 17, 18, 19; 364/410.1; 395/200.5

[56] References Cited

U.S. PATENT DOCUMENTS

| | | | |
|---|---|---|---|
| 4,902,020 | 2/1990 | Auxier | 273/256 |
| 5,009,429 | 4/1991 | Auxier | 273/240 |
| 5,083,800 | 1/1992 | Lockton | 273/439 |
| 5,096,202 | 3/1992 | Hesland | 273/237 |
| 5,324,035 | 6/1994 | Morris et al. | 273/138 |
| 5,351,970 | 10/1994 | Fioretti | 273/439 |
| 5,393,057 | 2/1995 | Marnell, II | 273/85 |
| 5,505,449 | 4/1996 | Eberhardt et al. | 273/138 |
| 5,536,016 | 7/1996 | Thompson | 273/269 |
| 5,569,083 | 10/1996 | Fioretti | 463/19 |
| 5,586,937 | 12/1996 | Menashe | 463/41 |
| 5,737,560 | 4/1998 | Yohanan | 395/349 |
| 5,746,656 | 5/1998 | Bezick et al. | 463/42 |
| 5,816,918 | 10/1998 | Kelly et al. | 463/16 |
| 5,823,879 | 10/1998 | Goldberg et al. | 463/42 |
| 5,830,069 | 11/1998 | Soltesz et al. | 463/42 |

*Primary Examiner*—Jessica J. Harrison
*Assistant Examiner*—John M Hotaling, II
*Attorney, Agent, or Firm*—Testa, Hurwitz & Thibeault, LLP

[57] ABSTRACT

The gaming systems according to the invention include hardware and software systems that allow a large arena of participants to interactively play a game of chance or skill. Generally, the invention can be understood game servers that generate page signals, such as HTML pages, that are representative of a hand being played, or dealt to a participant in a large arena game. For example, the game server can generate for each participant in a large arena game a page that is representative of a bingo card dealt to that participant. Each of the pages generated by the server includes a control mechanism, such as a check box or radio button, that allows the server to collect information from the participant to determine the moves being played by that participant. The gamer server collects from each participant the moves being played by the participant and as a function of the moves played and the hand dealt, the game server generates a new page that shows the progression of the participant through the game.

18 Claims, 6 Drawing Sheets

SYSTEMS FOR PROVIDING LARGE ARENA GAMES OVER COMPUTER NETWORKS

FIELD OF THE INVENTION

The invention relates generally to systems for providing large arena games, such as bingo, over computer networks. More particularly, the invention relates to methods and apparatus for enabling large arena games to be played in real time over a computer network.

BACKGROUND OF THE INVENTION

Today, systems that allow games to be played over computer networks generally require that the participant downloads a large, i.e. five to eight megabyte, file of executable code designed to run on a particular platform. Once the code has been downloaded to the client machine, the player activates the code and begins playing the game. In some cases a small number of users at other network sites which also store the proper executable code, can join in the game and the players can compete. However, although these systems will allow a limited number of players to participate in a single game, the required download is time consuming and burdensome and none of these games will allow for anymore than a few participants. Moreover, these games will only execute on particular platforms, and even on those platforms the act of configuring the software to allow competition over the computer network can be complex and can risk crashing the network.

Other network gaming systems exist that do not require the players to download large files of executable code. In these systems players access a server site that allows the user to purchase or select a gameboard, such as a lottery ticket or a Keno card. The player then waits until the time for purchasing cards has passed and the server then selects and announces a winner or winners for the game. Although, these systems work well to allow players to take part in a lottery or similar game of chance, these games are passive and fail to involve the players in the game or in competition with each other.

Still other network gaming systems exist that allow a player to access a server to participate actively in a game. However, few of these games can be played in real-time and none allow for large arena of players to participate and compete in the same game.

SUMMARY OF THE INVENTION

Accordingly, it is a object of the invention to provide methods and apparatus for enabling large arena games to be played in real time over a computer network.

Other objects, embodiments and features of the invention and the manner of obtaining them will become apparent to those skilled in the art, and the invention itself will be best understood by reference to the following detailed description read in conjunction with the accompanied drawings.

The gaming systems according to the invention include hardware and software systems that allow a large arena of participants to interactively play a game of chance or skill. Generally, the invention can be understood game servers that generate page signals, such as HTML pages, that are representative of a hand being played, or dealt to a participant in a large arena game. For example, the game server can generate for each participant in a large arena game an HTML page that is representative of a bingo card dealt to that participant. Each of the pages generated by the server includes a control mechanism, such as a check box or radio button, that allows the server to collect information from the participant to determine the moves being played by that participant. The gamer server collects from each participant the moves being played by the participant and as a function of the moves played and the hand dealt, the game server generates a new HTML page that shows the progression of the participant through the game.

In accordance with one aspect of the invention, a method for providing gaming to a large arena of participants is described, comprising the steps of: (a) providing a game server for generating page signals having information representative of a hand being played by one of the participants in a game and information representative of a game event, and wherein each page includes a mechanism for collecting a reply from one of the participants to indicate the participant's move in the game, (b) allowing each participant in the game to employ a client process operating on a client station to connect to the game server through a computer network and to download a respective one of the page signals from the game server, (c) directing each participant in the game to employ the client process to enter a reply to the page signal in response to the game event, to indicate a play in the game, and (d) directing the game server to generate a page signal as a function of the participant's move in the game and an event in the game, whereby the game server continues to generate page signals to guide each participant through the procession of play in the game.

In certain specific embodiments of the invention the game server generates the page signals as HTML pages, XML pages, VRML pages, or another type of computer file that can be employed by a client process for developing an markable graphical interface for the client. In these the methods, the step of providing a client process can comprise the step of supplying a browser process, such as the Netscape Navigator browser.

In one illustrative process of the invention, the participants generate register-winning claim signals that are transmitted to the game server to indicate a successful completion of the game. The game server can verify the winning claim by checking the plays made by the participant during the game. A verified win can be rewarded by the payout of a prize, including a monetary reward. To this end, the process can store contact information for each player in the game in order that the prize can be readily forwarded to the winning player.

In a further practice, the process can include a registration process for allowing users to request participation in the game. Further, a lock-out process can be provided that limits the number of participants allowed to register to participate in the game. Additionally, the process can include a fee entry process for charging one or more of the participants a fee for registering in the game.

In still a further practice the process can include steps for providing a players list that is representative of the players registered to play the game. The process can store the players list in a player database for the duration of the game. If a client gets disconnected from the game and attempts to rejoin the game, the process can access the player database to determine if the player had been previously registered to play in the game. Optionally, the players list can include information describing the status of the player's last played hand in the game, to allow the rejoining player to continue playing from their last hand.

In a further practice, the processes can include the steps of directing the game server to generate page signals that include fields of pregenerated data, such as GIF files, WAV files, or other files of computer readable information, and directing the game server to generate a load_page signal having information for allowing the client process to download and cache store the fields of pregenerated data, whereby the client process can access the cache stored fields of pregenerated data when creating displays for the player. These steps allow the process to pre-load Figures and other information that is to be displayed to the player during game play.

The processes can also include the steps of directing the game server to detect an event representative of the end of the game and to provide, responsive thereto, interstitial pages representative of pregenerated data for viewing by player waiting for the beginning of a new game. These interstitial pages can include pregenerated data that includes advertisements which the server selects for the player based on the demographic data supplied by the player.

In a further practice, the processes can include the steps of allowing the participants to select from a plurality of games. To this end the game server can be an extensible game engine for allowing the game server to service a plurality of different types of games, such as bingo, or picturerama, as well as provide a plurality of different difficulty levels, themes or other variations on a particular game. In picturerama a gameboard is created that includes an unfinished jigsaw puzzle that serves as a clue to solve a word problem, such as a scrambled word problem. Other similar games can be provided by the same game engine.

In a further aspect, the invention includes a game server that includes an extensible game engine that can generate a game-player object having information representative of an abstract model of a game and information representative of an abstract model of a game board, each of the abstract models being capable of storing data for representing a participant in the game. The engine can further generate a game object for representing a plurality of different types, or categories of games, the game object having a set of functions each being representative of an abstract gaming operation to provide a set of procedures for implementing any of the plurality of different types of game.

In a further embodiment, the systems include data files of executable code, such as a java applet, that can be downloaded to a client process for drawing a game board and for editing the game board responsive to moves made by the respective player participant. Alternatively, the game board can be provided by a server process that downloads pages, such as HTML pages to the client process. In such systems the game server can generate page signals having information representative of a hand being played by one of the player participants in a bingo game and information representative of a bingo game event, and wherein each page includes a mechanism for collecting a reply from one of the participants to indicate the participant's move in the bingo game. A client process can connect to the game server through a computer network and download a respective one of the page signals from the game server, and for entering a reply to the page signal in response to the game event, to indicate a move in the bingo game. The game server can generate a page signal as a function of the participant's move in the game and an event in the game, whereby the game server continues to generate page signals to guide each participant through the procession of play in the game.

DETAILED DESCRIPTION OF THE ILLUSTRATED EMBODIMENTS

The invention will now be explained with reference to certain illustrative embodiments, which are exemplary and not to be understood as limiting, or an exhaustive representation of the invention.

Figure 1:
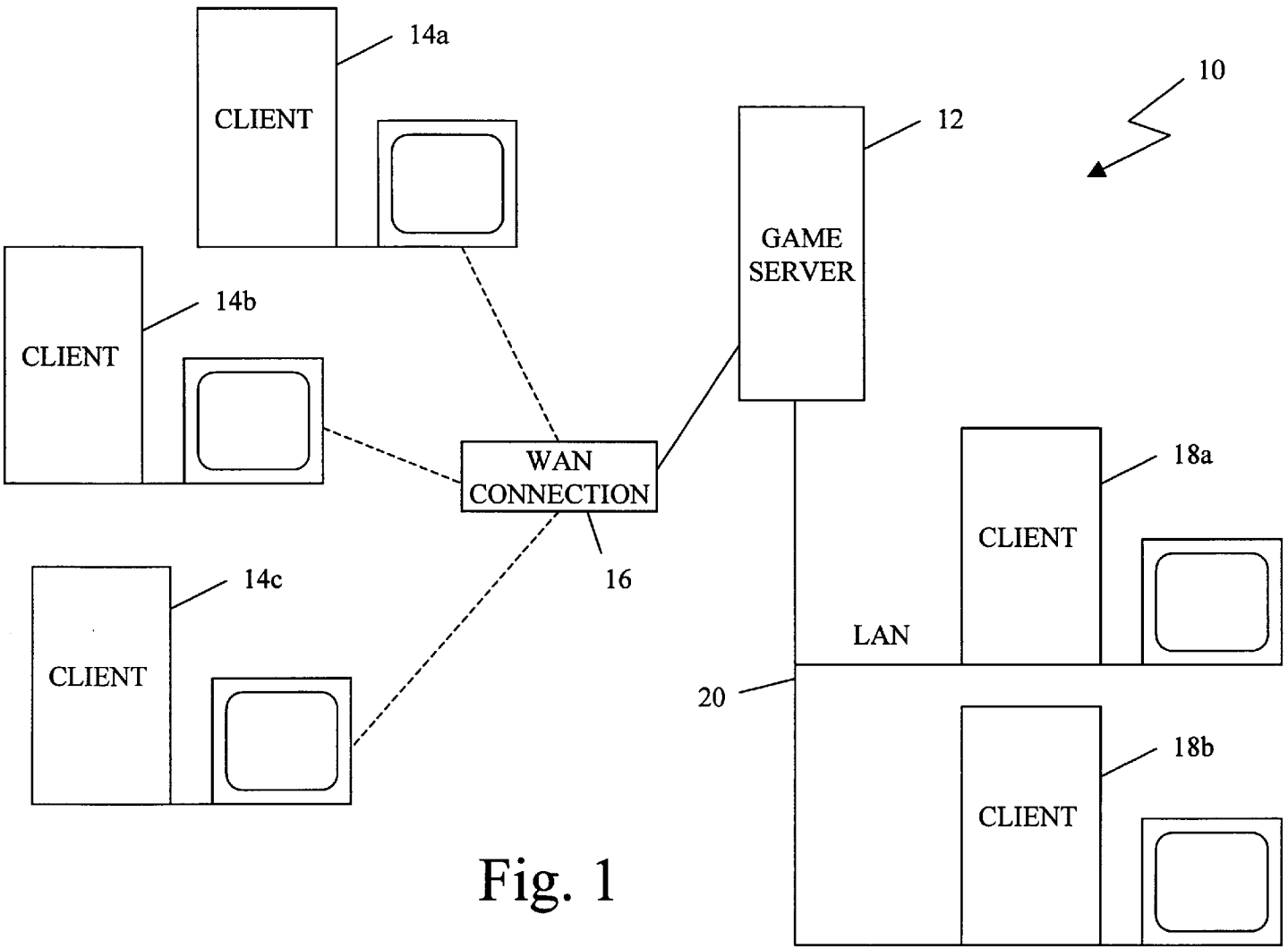
FIG. 1 illustrates a computer network system according to the invention for providing a large arena gaming.

FIG. 1 depicts a system 10 that comprises a computer network system for providing large arena gaming. System 10 includes a game server 12, a plurality of client stations 14A, 14B, and 14C, a wide area network connection (WAN) 16, a plurality of local area network area clients 18A and 18B and a local area network (LAN) 20.

The depicted game server 12 is a game and advertisement engine that generates and serves game board pages to the participants of the large arena game. The computer platform of the game server 12 can be an MIPS R10000, based mullet-processor Silicon-Graphic Challenge server, running IRIX 6.2.

The game server 12 can connect to a database served from a series of local 7200 RPM Seagate hard drives. The game server 12 can connect to a wide area network, such as the Internet, via a shared 10 megabit ethernet connection to a router. Preferably the router is selected for its proximity to a major internet node, such as the MAE-EAST internet node. FIG. 1 depicts this ethernet connection as the WAN connector 16.

Each participant of the game can sit at a client station, such as the depicted client stations 14A, 14B and 14C. Each of the client stations can be a conventional personal computer system, such as a PC compatible computer system that is equipped with a client process that can operate as a browser, such as the Netscape browser program that allows the client station to download computer files, such as web pages, from the game server 12.

FIG. 1 further depicts that the game server 12 can connect via a local area network (LAN) 20 to a plurality of client elements, such as client stations 18A and 18B. Again, each of the depicted client stations 18A and 18B can be conventional computer stations, such as PC compatible computer systems that are equipped with a process for receiving computer files from the game server 12. Accordingly, the systems of the invention allow for providing a large arena game over an intranet. It therefore will be seen that one advantage of these systems is that a gaming complex, such as a casino, or bingo parlor can be assembled from commercially available and inexpensive computer equipment that is suitable for providing an intranet network.

It will be apparent to one of ordinary skill in the art, that the game server 12, and client stations 14A–14C and 18A–18C can comprise conventional commercially available computer hardware that becomes configured according to the systems of the invention by the operation of computer software that configures the conventional computer hardware to operate as systems according to the invention.

Figure 2:
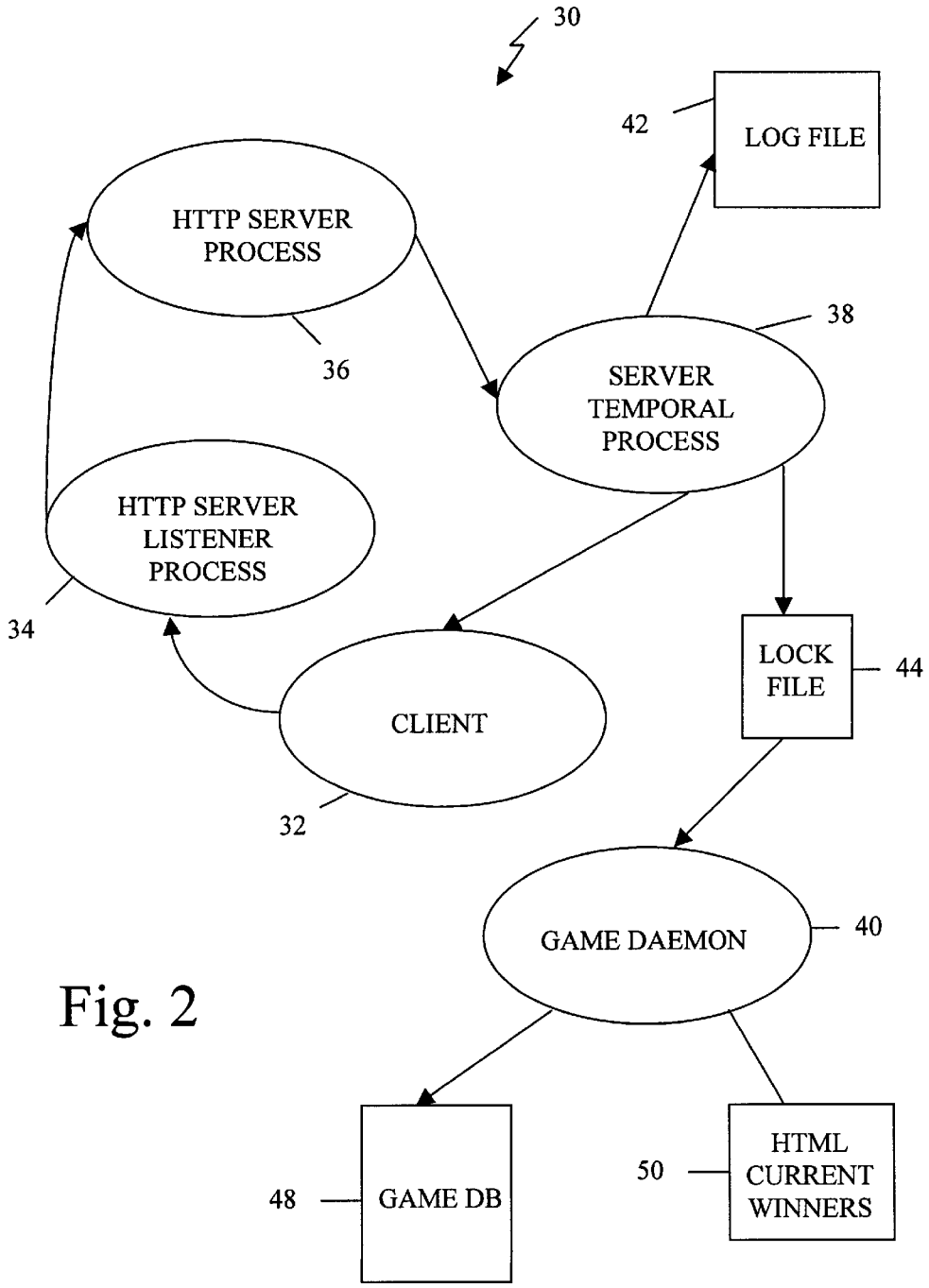
FIG. 2 illustrates diagrammatically one embodiment of a software system suitable for operating on the computer network system depicted in FIG. 1.

FIG. 2 depicts diagrammatically one embodiment of a software system suitable for configuring the conventional computer hardware depicted in FIG. 1 to operate as a system according to the invention. In particular, FIG. 2 depicts a software system 30 that includes a client process 32, an HTTP server listener process 34, an HTTP server process 36, a server temporal process 38, a game daemon 40, a log file 42, a lock file 44, a game database 48, and an HTML current winners page 50.

The client process 32 can be a computer program operating on the client stations such as those depicted in FIG. 1, that are capable of downloading and responding to computer files served by the game server 12. In particular, the client process 32 can be a browser program that is capable of forming one or more connections to an HTTP server process for transferring pages from the HTTP server process to the client process 32. Such a browser process can be the Netscape Navigator browser process, the Microsoft Explorer browser process, or any other conventional or proprietary browser process capable of downloading pages generated by the game server 12.

FIG. 2 further depicts that the client process 32 forms one connections to the HTTP server listener process 34. The HTTP server listener process 34 can be an executing computer program operating on the game server 12 and which monitors a port, typically well-known port 80, and listens for client requests to transfer a resource file, such as a hypertext document, an image, audio, animation, or video file from the server's host to the client process host. In one embodiment, the client process employs the hypertext transfer protocol (HTTP) wherein the client process 32 transmits a file request that specifies a file name, an internet location (host address), and a method, such as the HTTP, or any other proprietary or standard protocol suitable to retrieve the requested file. The HTTP server listener process detects the client request and passes the request to the executing HTTP server processors, such as the HTTP server process 36. It will be apparent to one of ordinary skill in the art, that although FIG. 2 depicts one HTTP server process, a plurality of HTTP server process can be executing on the game server 12 simultaneously. The HTTP server processors will pass the file request typically round-robin style until an HTTP server process is identified that is available to service the client's request.

In one embodiment, the HTTP server process that is available to service the request will cause a server temporal process, such as the server temporal process 38, to be forked off. The server temporal process 38 receives the client's request and processes it to generate a page signal to be served to the client. The server temporal process 38 generates a page signal that is representative of the hand that the player is playing in the game. For example, the server temporal process will process the client file request to generate a page signal that is representative of a bingo card that the client is playing in a bingo game.

In one embodiment, the server temporal process 38 is a non-parsed header CGI script that produces an HTML page that is passed to the client process 32. The client process 32 will decode the page signal and display to the participant the participant's hand in the game.

Figure 3:
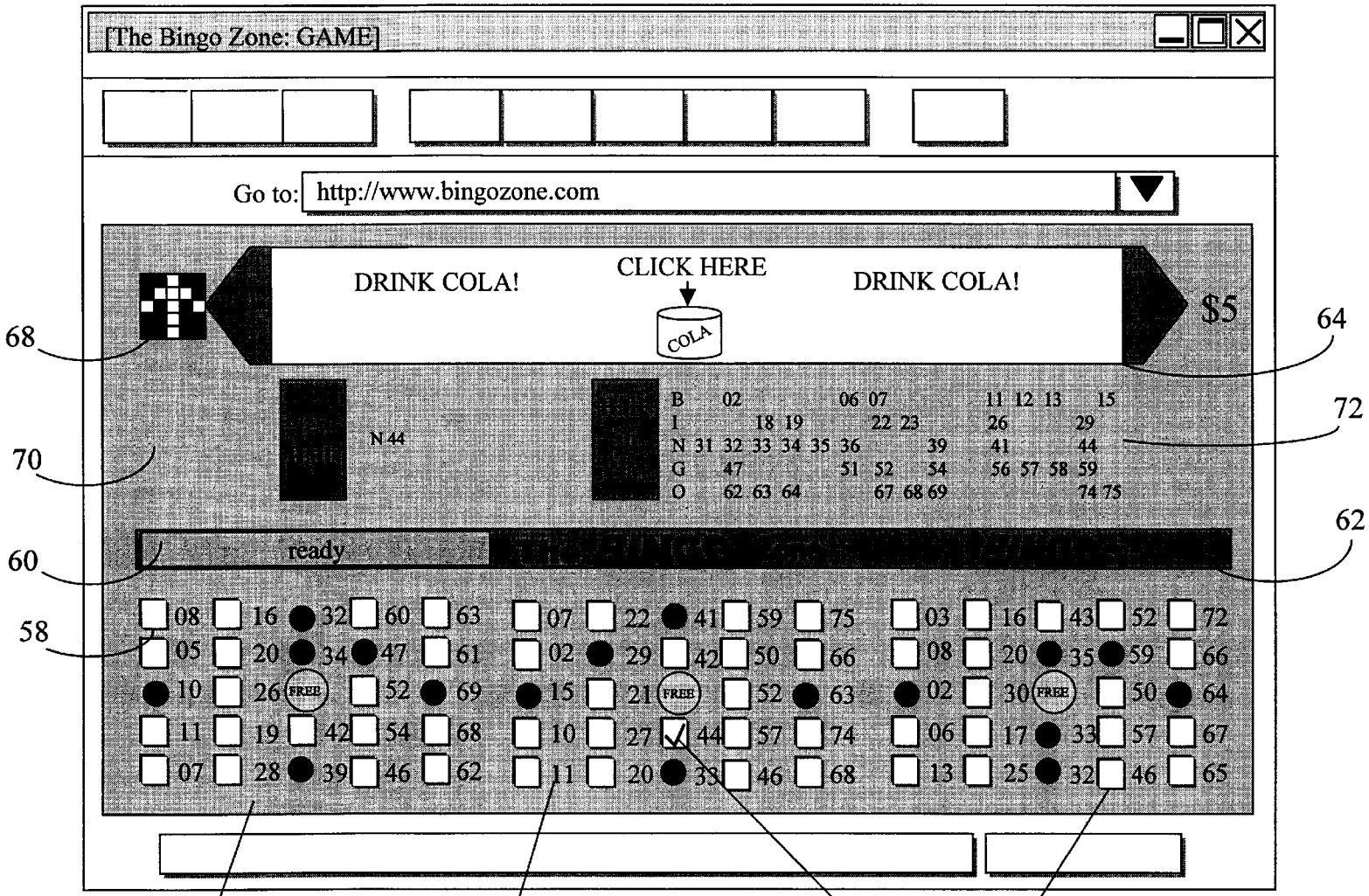
FIG. 3 illustrates one game board suitable of the type generated by the system for providing large arena gaming.

Continuing with the example described above, the HTML page served by the server temporal process 38 to the client process 32 will be processed by the client process, the browser program, to generate a graphical image of the bingo card being played by the participant. The page displays to the participant the hand being played by that participant, as well as information that is representative of a game event, such as the drop of a bingo ball. Additionally, the page will include controls and mechanisms for collecting replies from the participants, wherein the replies are representative of the participant's move in the game. For example, an HTML page processed by client process 32 can include an array of check boxes formed into a bingo card wherein each check box is associated with one of the letter number combinations, such as B6, contained on the bingo card. This graphical image is depicted in FIG. 3. In particular, FIG. 3 shows a client process that is a Web browser process which is displaying an HTML page generated by the server temporal process 38. In particular, FIG. 3 shows that the page includes three bingo hands 52, 54 and 56, two game controls a ready control 60 and a bingo control 62, an advertisement block 64, a game definition picture 68, a new ball field 70 and a dropped ball field 72. Although FIG. 3 depicts a bingo card within the game board, it is to be understood that the invention is not to be limited and any large arena game, including picturerama, premonition or other game, can be practiced with the present invention without departing from the scope thereof. Premonition is a game of skill that provides a series of clues derived from the plays made by a participant, wherein the clues direct the participant to the answer to a puzzle.

As further shown in FIG. 3, each of the bingo cards 52, 54, and 56 comprises an array of check boxes such as check box 58 or 59, that collect from the participant the participant's move in the game. In the game illustrated by FIG. 3, a participant will check each check box 58 on one of the displayed bingo cards that corresponds to one of the entries in the new ball field 70 or the ball dropped field 72. A checked box is depicted by box 59. Check box 59 depicts a check box in an activated state and which the client process 32 will transform into a message that provides the game server 12 with information representative of the moves played by the participant during the bingo game.

In this way, the client process directs the participant to reply to each game event, such as a ball drop, by making a move in the game, such as checking one of the check boxes that corresponds to an entry on a bingo card that has been called by a dropped ball.

The participant can enter their move in the game by activating the ready control 60. The ready control 60 directs the client process 32 to connect to the HTTP server listener process 34 as depicted in FIG. 2. Returning to FIG. 2 it can be seen that the client file request generated by activating the ready control 60 causes the HTTP server listener process 34 to identify an available HTTP server process, such as the process 36. The available server process 36 will fork off a server temporal process 38 and will pass to the server temporal process 38 the client file request which includes information that is representative of the moves made by the client, such as the boxes checked on the bingo boards. The server temporal process 38 will process the information provided by the file request to generate a new page that has been updated to show the moves made by the participants, as well as by the occurrence of any new game events, such as the additional dropping of balls, or the calling of bingo by a participant.

In one embodiment, the server temporal process 38 generates a new page by accessing a player database that contains, inter alia, a player's list having an entry for each participant in the game. Each entry can include a description of the most recent page served to the participant. The server temporal process 38 can process the information in the player database along with the information received with the client file request to generate a new HTML page that provides check boxes only for those bingo card entries that have not been marked by the participant, and to provide for each bingo entry checked by the participant with a pointer to a file that is representative of a picture of a bingo ball. The server temporal process 38 also determines the number of bingo balls that have dropped since the last update of the participant's game page and provides that information within the new ball field 70. Optionally, the server temporal process 38 also updates the dropped balls field 72 to include therein those entries listed as new balls in the last page provided to the client process 32.

Accordingly, it will be seen that the game continues as a sequence of page generation and reply deliveries with the client process 32 connecting to the HTTP server listener process 34 each time the participant makes a play in the game, such as requesting a new ball or declaring that the game has been won, or another transition point within the game.

By declaring that a game has been won, such as by calling bingo by activating the bingo control 62 shown in FIG. 3, the client process 32 sends a message to the game server 12 that the game is at a transition point, in this case, that the game is to end. Upon receiving this message, the server temporal process 38 verifies whether the participant has registered a valid winning claim. For example, in a bingo game, the server temporal process will verify that the participant has actually formed on one of their three bingo cards the game winning pattern identified in the game field 68 shown in FIG. 3. In one embodiment, the server temporal process 38 actually determines the pattern marked by the client and determines that each of the bingo entries marked by the client corresponds to a ball dropped during the bingo game. Alternatively, the server temporal process 38 can declare the participant a valid winner if one of the three bingo cards provided to participant has entries that correspond to balls dropped during the game which, if the client had marked them, would form the pattern depicted in the game picture 68. Other methods suitable for verifying a winning claim can be practiced with the present invention without departing from the scope thereof. Thus, it will be seen that an advantage of the present invention is that it allows real-time detection and verification of a winning claim and that the server can identify and announce each winner of a game before commencing the next game.

Returning to FIG. 2, it is depicted that the server temporal process 38 creates a log file 42 in which the server temporal process 38 stores a signal that identifies whether the participant has made a valid claim for a win. In one practice, the server temporal process 38 stores the player identification information within the log file 42 along with an entry that indicates whether or not the participant had validly registered a winning claim. In one optional embodiment, a registration process can pull information stored in the log file to prevent any participant that has made an invalid winning claim, or a predetermined number of invalid winning claims from entering into any more games for a predetermined period of time. In this way, a participant that has falsely declared winning of claims a predetermined number of time can be banned from the gaming system for a period of time.

Upon detecting a valid winning claim, the server temporal process 38 provides to the game daemon 40 information that is representative of the participant that has a winning claim. The game daemon 40 can create a lock file 44 that includes information such as the date of the win, the user name of the winning participant, the hand that a participant held when declaring their win and any other information characteristic of the winning event. In this embodiment, the server temporal process 38 can include a step of checking to see if a lock file 44 is in existence for a particular game. If the server temporal process 38 detects a lock file 44, then the server temporal process 38 generates a page for each client process 32 that will display to each participant that a valid winning claim has been registered. In this way, each participant is notified of the imminent end of the game and any participant also holding a winning hand can be given a certain grace period for registering a winning claim. The page that declares the valid winning claim event can also include a control that allows a user to exit the game and return to an interstitial page where the participant can view advertisements, read text, chat with other participants, or take part in some other activity while awaiting the commencement of the next game.

FIG. 2 shows that the game daemon 40 processes the message sent from a server temporal process 38 that identifies a participant having a valid winning claim and generates from this information an current winner page that can list every winner of the game being played. This page can then be displayed by the server temporal process 38 to the plural client processes 32 to allow each of the participants to know the identity of the winning participant. Optionally, the current winner page can also include a graphical depiction of the winning board played by the participant.

Figure 4:
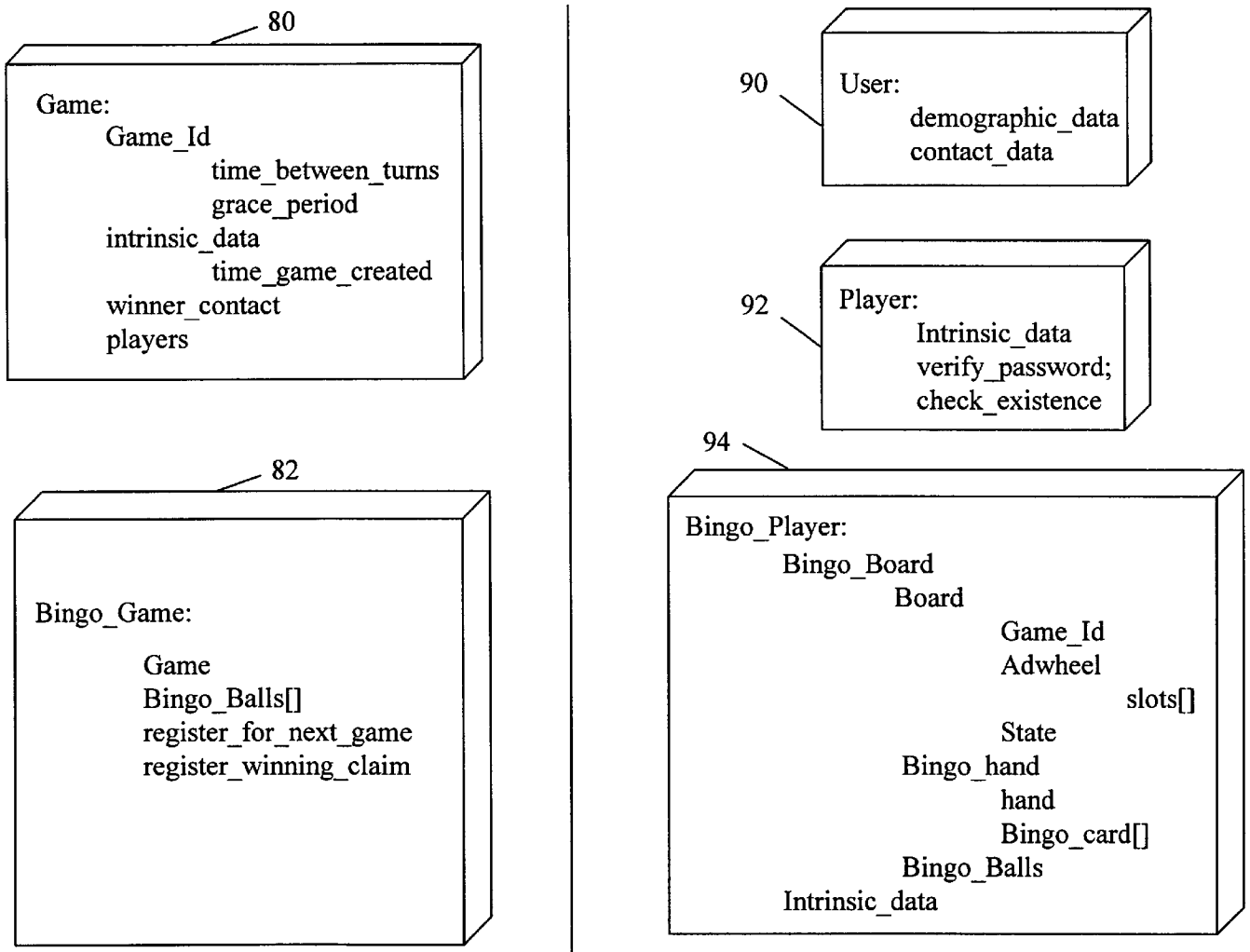
FIG. 4 illustrates a set of objects of the type employed by one embodiment of a system according to the invention.
Figure 5:
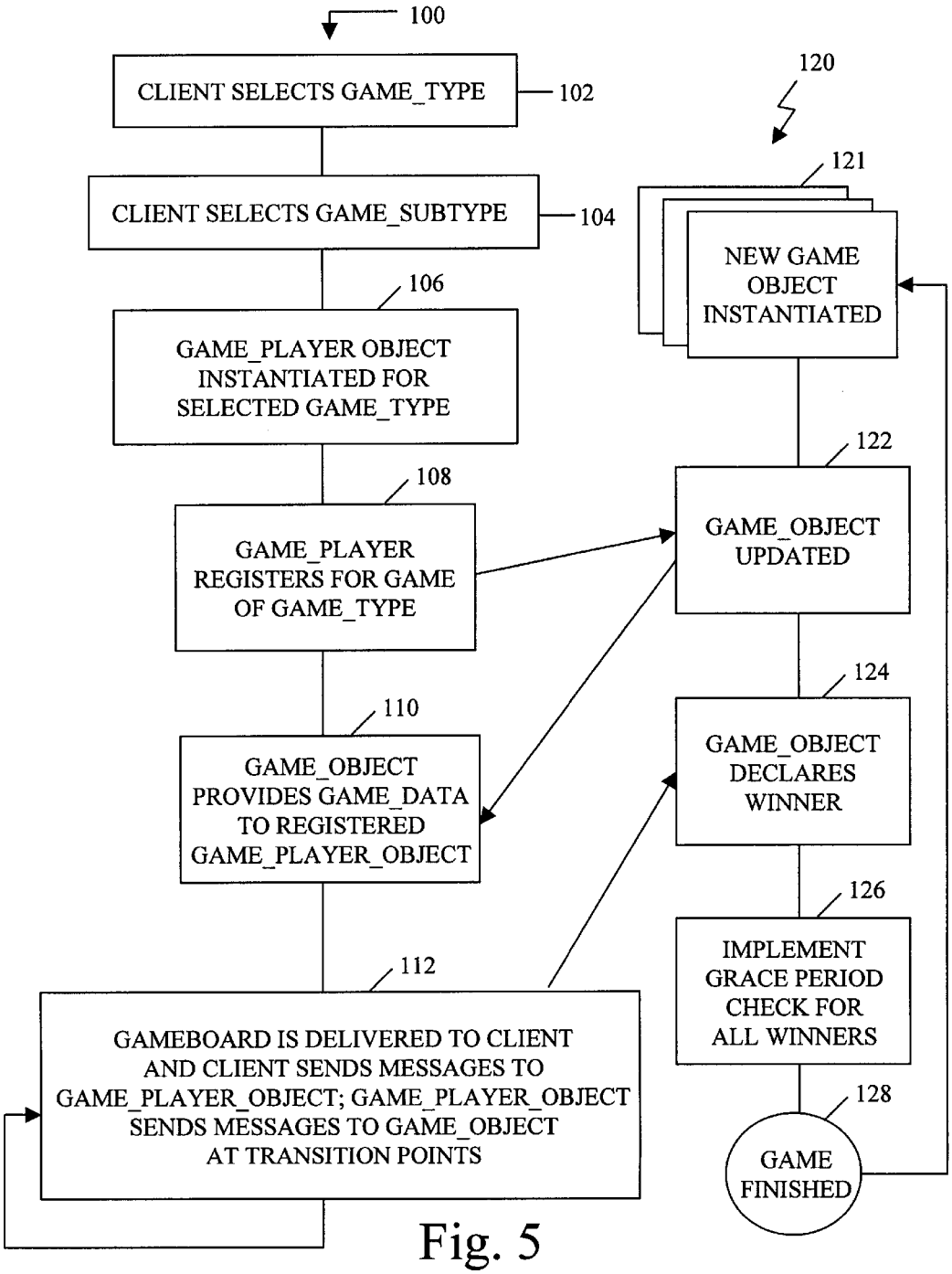
FIG. 5 depicts a flowchart of one process according to the invention.

FIGS. 4 and 5 depict the design of one game server and game daemon of a software system such as that shown in FIG. 2. In particular, FIGS. 4 and 5 depict an extensible game engine that supports real-time play of large arena games, which are understand as games that involve large numbers, such as 1300, of simultaneously playing participants. The engine design is scalable to allow modular increases in capacity. Further, by being extensible, the engine can support a wide variety of applications, including a variety of large arena games such as bingo at beginning, intermediate and advanced levels, picturerama or any other large arena game.

In particular, FIG. 4 depicts class templates for a game class 80 that can have subclasses including the depicted bingo game subclass 82, as well as game subclasses for picturerama, premonition, or game sub-classes for subtypes of large arena games including beginning bingo, intermediate bingo or advanced bingo in which the number of cards, or the pace of the game may vary with the level of difficulty. The depicted class 80 can include a Game_Id that can be a unique identifier for the game object, wherein the game object is representative of one of the games in play and being serviced. The Game_Id can also include sub-fields that are representative of information characteristic of the game, such as the time between turns, i.e., the amount of time that occurs between game events, such as the dropping of a bingo ball, the maximum allowed duration of the game, the grace period for registering a winning claim, or other such game data. The game class can also include intrinsic data that has information that is descriptive of the game object, such as the time the game was created. Additionally, the game object can include information representative of the winner of the represented game and information that is representative of how to contact the winning participant to provide notice or a prize. The depicted game class 80 also includes players information that is representative of the players registered in the game.

The depicted bingo game class 82 includes the Game information of the game class 80 and additionally includes information that is descriptive of a bingo game. As FIG. 4 shows, the bingo game class 82 can include bingo game data such as an array of numbers that is representative of the bingo balls dropped in for the game. It will be understood that this array can include a complete set of the bingo balls that are to be dropped for a game and that all bingo balls can be dropped at once at the point of creation of the bingo game, or dropped for all bingo games at the start of a day. This provides the advantage of increased service efficiency by eliminating a step during the bingo game of calculating a new bingo ball each time the participants request a ball, and therefore aids in providing the real time service of the large arena game. The bingo game class 82 can also include functions for registering for the next game, and registering for a winning claim.

Accordingly, the extensible game engine of the invention can employ an abstract model of a game, such as the model defined by the game class 80 and a game subclass, such as the bingo game subclass 82. Furthermore, different game subclasses can be included for allowing the game engine to service a plurality of different game types at the same time. As the game engine contains data and performs operations that is applicable to all game subclasses, the game engine is readily extensible to service different games. In the depicted embodiment, the game engine can be written as an object oriented computer program, such as a C++ program, that directs the objects to perform the necessary operation to distinguish themselves from other objects of different subclasses. The Bingo game class will drop balls for a bingo game, while a picturerama game class can generate an image of an incomplete jigsaw puzzle. Accordingly, the depicted classes and subclasses provide for the instantiation of objects that have state behavior and identity for a particular large arena game, shown in the example as bingo. However, it will be apparent to one of ordinary skill in the art of computer science that the depicted game classes and subclasses are exemplary and not an exhaustive list or an inflexible design of such classes and further that additions, subtractions, and modifications can be made to these classes and subclasses without departing from the scope of the invention. It will further be known to one of ordinary skill in the art of computer science that the development of such class structures is described in Grady Booch, "Object Oriented Design with Applications", the Benjamin/Cummings Publishing Co., Inc. (1991).

FIG. 4 further depicts a set of classes for defining the player participants in the large arena game. In the depicted embodiment, the classes include a user class 90, a player 92 and a player subclass shown as the bingo player subclass 94. The user class 90 is employed in this embodiment to include data that is seldom changed by the participant, such as demographic of the participant and contact data. The demographic data can include the information provided by a participant when filling out an HTML form for registering with the website that provides the large arena gaming services. In particular, the demographic data can include information that is descriptive of the participant such as the participant age, sex, hobbies, or any other demographic data that can be collected from a participant through a form. Further, the user class 90 can include contact data information that can be representative of the information necessary for contacting the registering participant to deliver information to that participant. For example, the contact data can include the mailing address of the participant as well as an e-mail address for the participant. The contact data can be employed by the game server to forward to the participant the prize won during the play of the game, as well as to forward other marketing or advertising literature.

It will be noted that in this embodiment the user class contains information that is generally static or that at least is understood to change seldomly. Accordingly, this information is separated out into a separate class from the player class 92. This separate user class that holds generally static information, increases the efficiency of the gaming service and provides real time performance by reducing data that has to be written to persistent memory, such as a Seagate hard drive, during the operation of the gaming service. However, it will be apparent to one of ordinary skill in the art of computer science that in alternate embodiments of the invention the user class 90 and the player class 92 can be combined into a single class.

The player class 92 depicted in FIG. 4 includes intrinsic data for the player class. A board class, not depicted, can be representative of data for a generic game board page that is provided by the server to the participant, such as the page depicted in FIG. 3.

The bingo board depicted in FIG. 3 is instantiated from the bingo player subclass 94 depicted in FIG. 4, which includes a bingo board having bingo state data, bingo hand data, which includes bingo card data, bingo balls, an adwheel, and other intrinsic data. As described above, the bingo board data of class 94 can have all the information for generating the page that is ultimately served to the participant. The board data can include the state of the players hand being played, the hand dealt the player, and the cards that makeup the hand dealt the player. Given the object oriented design of the extensible game engine, the bingo board object will behave as a bingo board and will draw the bingo game board that is transmitted to the player. Similarly, a picturerama board object will draw a picturerama gameboard to be delivered to the player. Similarly, further subclasses will behave appropriately to draw the proper gameboard for that subclass.

This is understood more clearly with reference to FIG. 3 that shows a full HTML page which includes advertising fields, such as the fields 64 as well as the game play fields 68 and further includes the state of the game being played, such as the new balls that have been dropped shown in field 70 and the balls that have been dropped shown in field 72. Additionally, the game board includes the hand provided to the participant which in the example shown in FIG. 3 is comprised of the three bingo cards that were generated for the player participant. This can include the bingo state, the bingo hand comprised of one or more bingo cards, as well as the bingo balls that were dropped for the game being played. The game server can reveal the bingo balls to the participant in a timed succession. Again, as described above, by generating all the bingo balls to be played in a game at the beginning of the game and by providing this information to each player in the game, the efficiency of the systems is increased to allow for real time performance of the large arena game.

Additionally, the bingo player class 94 can include adwheel information. The adwheel information can be generated for each bingo player during a registration phase in which information stored in the user object 90 that is related to the demographic data of the participant is employed as filter information for determining a set of ads to be displayed to the participant. These ads can be displayed to the participant during the bingo game, such as depicted in FIG. 3, as well as during intermissions. The adwheel can include a number of slots each slot being capable of holding information representative of an ad. The server temporal process can sequence through the adwheel to change sequentially which ads are incorporated into the sequential game boards provided to the player participant. In this way, each time the participant indicates they are ready to receive a new ball, and therefore a new page, the provided bingo board can come with a new advertisement for the player to view. It will also be understood that by altering the time period between turns data, that in this embodiment is depicted as data within the game class 80, the server can control the length of time that a game board is instantiated for the player to view, thereby controlling the length of time that an advertisement is displayed to the player participant. The bingo player class 94 can also include intrinsic data such as the number of games the bingo player has played, the number of times the bingo has won, the amount of money or other prizes the bingo player has won or other such information that is descriptive of the particular player participant that is associated with an object instantiated from a particular class, such as the bingo player class.

It is these objects that the system depicted in FIG. 3 creates and manipulates to provide the real time at a large arena game. One process for instantiating and manipulating such objects is depicted in FIG. 5. In particular, FIG. 5 depicts two processes 100 and 120 which interact to create and process game objects and player objects of the large arena game. The depicted process 100 includes the first two optional steps 102 and 104 wherein a client selects a game type and game subtype to choose the type of game the client wishes to play, such as bingo, picturerama or some other large arena game, as well as the game subtype which could be representative of the degree of difficulty, such as beginner, intermediate, or advanced, that the client wishes to play at. After step 104, the process 100 proceeds to step 106 wherein a game player object is instantiated for the selected game type. The game player object can be instantiated from a game player subclass such as the bingo game subclass as depicted in FIG. 4. The process 100 then proceeds to step 108 wherein the game player object registers for the game of the selected game type to allow the game player object to register for the game of the selected game type, the software system has instantiated a game object of the selected game class and subclass.

In one embodiment, the multiple new game objects are instantiated by the process before play begins and the player selects a game type or game subtype. In such a process, as in step 121, the multiple game objects can be instantiated at the beginning of the day to provide for all the games that are scheduled to be played that day. In alternative embodiments, the game object is instantiated as soon as one client indicates a desire to play that type of game. Other methods for coordinating events such as the instantiation of the game object with the clients selection, instantiation of a game player type, or other events can be practiced with the present invention without departing from the scope thereof. In one process of the invention, the game player object is instantiated by creating an object of the desired game class and subclass and fetching from a player database information that is representative of the registered game player. This information can be selected from the player database by directing a client wishing to participate in a large arena game to register with the game by entering a user name and password. The process of the invention can employ the user name and password to verify that the client is authorized to be a player in a large arena game, and the process can use the registration name as an index field for identifying within the player database the proper record for that client. The record will then provide information for generating the user object, including the demographic data and contact data for that particular client as well as other intrinsic information, such as the number of games previously played by that participant, the number of wins that participant had played before, and other such information that is maintained within persistent memory by the game server process.

After instantiating the game player object, the process 100 proceeds to step 108 wherein the game player object registers for the game of the selected game type. In one process of the invention, the game server employs this registration step to verify that the game player is authorized to participate in the game. Such authorization can depend upon whether or not the player has sufficient funds to purchase a hand for the game, as well as other criteria such as the number of times the player has registered a false winning claim for a game, or any other information or characteristic suitable for verifying if the player is to be allowed to register for the game. As further depicted by FIG. 5, the game object instantiated in step 122 will receive a message from the game player object that indicates that the game player object has registered for the game associated with that instantiated game object.

Step 108 proceeds to step 110, wherein the game object provides game data to the registered game player object. In one process, this step is accomplished by the game object instantiated in step 122 providing information to the game player object, such as the state of the game, the hand dealt to the game player object, the adwheel, and other such information for bringing the game player object into the game. When process 100 proceeds to step 112, the game player object has now been instantiated and provided with sufficient information to play the game. Accordingly, in step 112 the game board is delivered to the client and the client sends messages back to the game player object wherein such messages indicate the moves that the player is making in the game. In step 112 the client and server will continue to exchange messages and page signals until the game reaches a transition point, which can be, for example, that the player wishes to register a winning claim to end the game. This is shown by the arrow looping from the output of step 112 back into the step 112. In this case, the step 112 of process 100 proceeds to step 124 of the process 120. As described above, the game daemon can declare a winner to end the game for all participants, or optionally, as shown in step 126 to implement a grace period that checks for all possible winners in a game. After the expiration of the grace period, the process 120 proceeds to step 128 wherein a game is declared is finished. The process 120 will then proceed to activate the next game object that was instantiated during step 121.

It will be apparent to one of ordinary skill in the art of computer science that the above description describes one embodiment of a system for providing a real time, extensible server engine. However, it will also be understood that certain modifications, additions and subtractions can be made to the above-described embodiment without departing from the scope thereof.

Figure 6:
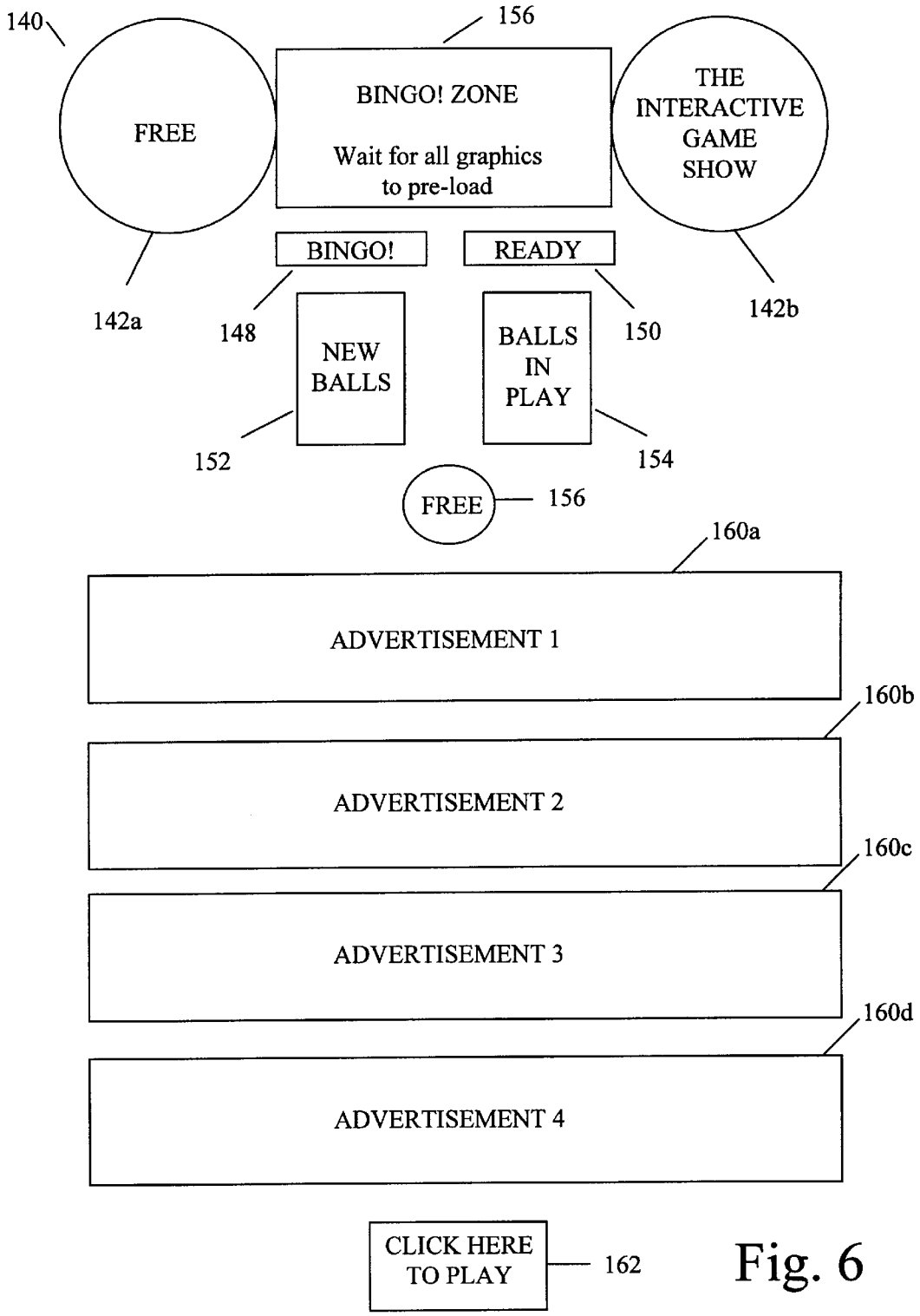
FIG. 6 depicts one embodiment of a load-page for allowing systems according to the invention to pre-load data for incorporation into the gameboard depicted in FIG. 3.

For example, one modification that can be made to the above-described embodiment includes the addition of a pre-loading step wherein pictures, audio files, and other information that is to be displayed within the game board during play is pre-loaded and cache stored on the client station to expedite the delivery of game boards and to facilitate real time service for the large arena game. FIG. 6 shows one example of such a pre-load page. The depicted pre-load page 140 can be delivered to the client during the registration process. For example, after the client has entered their user name and password, the game server can generate the pre-load page, typically a HTML page, by using the demographic data in the player database for the particular client, to select those advertisements that are to be presented within the game board during the process of the selected game. The game server can select the data files, such as GIF files that are associated with the advertisements that are to be displayed for the demographics of that particular user during the selected game and combine those files along with a set of GIF files that contain the data for creating the pictures of the controls that are to be depicted within a game board during the game process.

In the pre-load page 140 depicted by FIG. 6, the pre-load page includes a banner of graphical images that is comprised of the symbols 142A, 142B and 144. These three elements can represent a header for the pre-load page 140 that instructs the player to wait for all the graphics on the pre-load page to be downloaded to the client system. In this practice, the client process, such as the Netscape browser can be configured, as is the default, to cache-load the down loaded graphics, as well as other information files, and in subsequent operations check if an image within an page being served from the game server is already pre-stored in the cache memory of the clients system. If this is the case, the client process will eliminate down load step for any pre-loaded graphics and instead load graphics into a game board from the cache memory. This pre-load step will facilitate the realtime operation of the large arena game.

FIG. 6 further shows that the pre-load page can also include graphics for the control elements displayed on the game board page. For example, the pre-load page 140 includes the graphic devices 148, 150, 152, 154 and 156. With reference to FIG. 3, it can be seen that the pre-loaded graphic image 148 can correspond to the graphic image 62 in FIG. 3, the pre-loaded graphic image 150 can correspond to the user control 60 of FIG. 3, and that the pre-loaded images 152 and 154 pre-load the images that appear before the new field 70 and the balls in play field 72. A further example is illustrated by the free ball 156 that appears within the matrix of each bingo card 52, 54 and 56. It will be apparent to those of ordinary skill in the are that other images can be pre-loaded to facilitate the realtime operation of the server, for example, each game ball shown as a marked entry on a bingo card can be pre-loaded, the game type field 68 of FIG. 3 can be pre-loaded, as can other images, audio files, or other computer files that may be employed by the page signals provided by the game server to the client process during the play of the game.

What has been described in detail herein above are methods and apparatus meeting all of the afore stated objectives. As previously indicated, those skilled in the art will recognize that the foregoing description has been presented for the sake of illustration and description only. It is not intended to be exhaustive or to limit the invention to the precise from disclosed, and obviously many modifications and variations are possible in light of the above teaching.

The embodiments and examples set forth herein were presented in order to best explain the principles of the instant invention and its practical application to thereby enable others skilled in the are to best utilize the instant invention in various embodiments and with various modifications as are suited to the particular use contemplated.

It is, therefore, to be understood that the claims appended hereto are intended to cover all such modifications and variations which fall within the true scope and spirit of the invention.

What is claimed is:

1. A method for providing gaming to a large arena of participants, comprising the steps of:

providing a game server for generating page signals having information representative of a hand being played by one of the participants in a game and information representative of a game event, and wherein each page includes a mechanism for collecting a reply from one of the participants to indicate the participant's move in the game;

allowing each participant in the game to employ a client process operating on a client station to connect to said game server through a computer network and to download a respective one of said page signals from said game server;

directing each participant in the game to employ said client process to enter a reply to said page signal in response to said game event, to indicate a play in said game;

directing said game server to generate a page signal as a function of said participant's move in the game and an event in the game, whereby the game server continues to generate page signals to guide each participant through the procession of play in the game;

providing a registration process for allowing users to request participation in the game; and providing a lock-out process for limiting the number of participants allowed to register to participate in the game.

2. A method according to claim 1 including the step of directing said game server to generate said page signals as HTML computer files.

3. A method according to claim 1 including the step of directing said game server to generate said page signals as XML computer files.

4. A method according to claim 1 including the step of directing said game server to generate said page signals as VRML computer files.

5. A method according to claim 1 including the step of providing a client process that comprises a browser process.

6. A method according to claim 1 including the further steps of, allowing said participants to generate a register_to_win signal to said game server indicative of a successful completion of the game, and directing said game server to verify said register_to_win signal as a function of said plays made by said participant during said game.

7. A method according to claim 1 including the further step of providing a registration process having a fee entry process for charging one or more of said participants a fee for registering in the game.

8. A method according to claim 1 including the step of providing a players list representative of the players registered to play the game.

9. A method according to claim 8 including the further step of storing said player list for the duration of the game for allowing a user to rejoin the game being played.

10. A method according to claim 1 including the further step of directing said game server to generate a broadcast winner page having information representative of the winning participant of the game, and serving said winner page to each of said participants in the game.

11. A method according to claim 1 including the steps of directing said game server to generate page signals that include fields of pregenerated data, and directing said game server to generate a load_page signal having information for allowing said client process to download and cache store said fields of pregenerated data, whereby said client process can access said cache stored fields of pregenerated data.

12. A method according to claim 1 including the step of directing said game server to detect an event representative of the end of the game and to provide, responsive thereto, interstitial pages representative of pregenerated data for viewing by participants waiting for the beginning of a new game.

13. A method according to claim 1 including the further step of providing a cash payout to one or more of the participants in the game.

14. A method according to claim 1 including the further step of allowing the participants to select from a plurality of games.

15. A method according to claim 1 including the further step of providing said game server with an extensible game engine for allowing said game server to service a plurality of different games.

16. A method according to claim 15 including the further step of providing a game-player object having information representative of an abstract model of a game and information representative of an abstract model of a game board, each of said abstract models being capable of storing data for representing a participant in the game, providing a game object for representing a plurality of different types of games, said game object having a set of member functions each being representative of an abstract gaming operation to provide a set of procedures for implementing any of said plurality of different types of game, and directing said game object to operate said member functions responsive to data within said game-player object that is representative of a type of game being played, whereby said game object provides services responsive to the type of game_player thereby allowing said game object to service a plurality of game types.

17. A method according to claim 16 including the further step of providing one of said participants with a java applet for drawing a game board and for editing said game board responsive to moves made by said respective participant.

18. A method for providing gaming to a large arena of participants, comprising the steps of:

providing a game server for generating page signals having information representative of a hand being played by one of the participants in a game and information representative of a game event, and wherein each page includes a mechanism for collecting a reply from one of the participants to indicate the participant's move in the game;

allowing each participant in the game to employ a client process operating on a client station to connect to said game server through a computer network and to download a respective one of said page signals from said game server;

directing each participant in the game to employ said client process to enter a reply to said page signal in response to said game event, to indicate a play in said game;

directing said game server to generate a page signal as a function of said participant's move in the game and an event in the game, whereby the game server continues to generate page signals to guide each participant through the procession of play in the game;

providing said game server with an extensible game engine for allowing said game server to service a plurality of different games;

providing a game-player object having information representative of an abstract model of a game and information representative of an abstract model of a game board, each of said abstract models being capable of storing data for representing a participant in the game;

providing a game object for representing a plurality of different types of games, said game object having a set of member functions each being representative of an abstract gaming operation to provide a set of procedures for implementing any of said plurality of different types of game; and directing said game object to operate said member functions responsive to data within said game-player object that is representative of a type of game being played, whereby said game object provides services responsive to the type of game_player thereby allowing said game object to service a plurality of game types.

* * * * *